United States Patent [19]

Skinner et al.

[11] 4,014,305

[45] Mar. 29, 1977

[54] FUEL INJECTION PUMPING APPARATUS

[75] Inventors: Robert Thomas John Skinner, High Wycombe; Stanislaw Jan Antoni Sosnowski, London, both of England

[73] Assignee: C.A.V. Limited, Birmingham, England

[22] Filed: Jan. 28, 1975

[21] Appl. No.: 544,785

[30] Foreign Application Priority Data

Feb. 1, 1974 United Kingdom ..... 04681/74

[52] U.S. Cl. ..... 123/139 AQ; 123/139 AM; 417/202; 417/254

[51] Int. Cl.[2] ..... F02M 59/20; F04B 23/12

[58] Field of Search ..... 123/139 AP, 139 AQ, 123/139 AY, 139 AK, 139 AM, 139 AN, 139 AB, 139 AC, 139 BC; 417/252, 206, 219, 253, 462, 218, 221, 254, 202

[56] References Cited

UNITED STATES PATENTS

| | | | |
|---|---|---|---|
| 2,401,883 | 6/1946 | Pugh et al. | 123/139 AN |
| 3,439,624 | 4/1969 | Glikin et al. | 417/206 |
| 3,536,421 | 10/1970 | Kemp | 417/253 X |
| 3,930,484 | 1/1976 | Skinner | 123/139 AM |
| 3,936,232 | 2/1976 | Mowbray | 123/139 AQ X |

*Primary Examiner*—C. J. Husar
*Assistant Examiner*—Tony M. Argenbright

[57] ABSTRACT

A fuel injection pumping apparatus includes an injection pump for supplying fuel to an engine, feed pump for supplying fuel to the injection pump, and throttle means for controlling the amount of fuel supplied by the feed pump to the injection pump. Intermediate the throttle means and the feed pump is a first orifice, and downstream of this orifice is a tapping to which a control pressure is applied to a device operable to adjust the timing of injection of the injection pump. A valve is provided which includes a variable orifice connected in parallel with said first orifice, the valve being responsive to the outlet pressure of the feed pump to control the effective value of the first orifice.

8 Claims, 4 Drawing Figures

FUEL INJECTION PUMPING APPARATUS

This invention relates to liquid fuel injection pumping apparatus for supplying fuel to internal combustion engines, and of the kind comprising in combination, an injection pump for supplying fuel in timed relationship to an associated engine, a fluid pressure operable element for controlling the timing of injection of fuel to the engine, a feed pump for supplying fuel to the injection pump during the filling strokes of the injection pump and throttle means for controlling the amount of fuel supplied by the feed pump to the injection pump.

The object of the invention is to provide such an apparatus in a simple and convenient form.

According to the invention, an apparatus of the kind specified comprises a first orifice disposed upstream of said throttle means and through which fuel flows from the feed pump to the injection pump, a second orifice disposed in a passage branching off from intermediate said first orifice and said throttle means, valve means disposed downstream of said second orifice for controlling the pressure of fuel downstream of the second orifice so that it varies in accordance with the square of the speed at which the injection pump is driven, the pressure intermediate said first and second orifices being applied to said element, a relief valve for controlling the output pressure of the feed pump so that it varies substantially in accordance with the law ($N^2 + K$) where N represents the speed at which the injection pump is driven and K is a constant, and valve means including a variable orifice connected in parallel with said first orifice, said valve means being responsive to the output pressure of the feed pump and arranged so that as the output pressure of the feed pump increases, the effective size of the variable orifice decreases.

Examples of fuel pumping apparatus in accordance with the invention will now be described with reference to the accompanying drawings in which.

Figure 1:
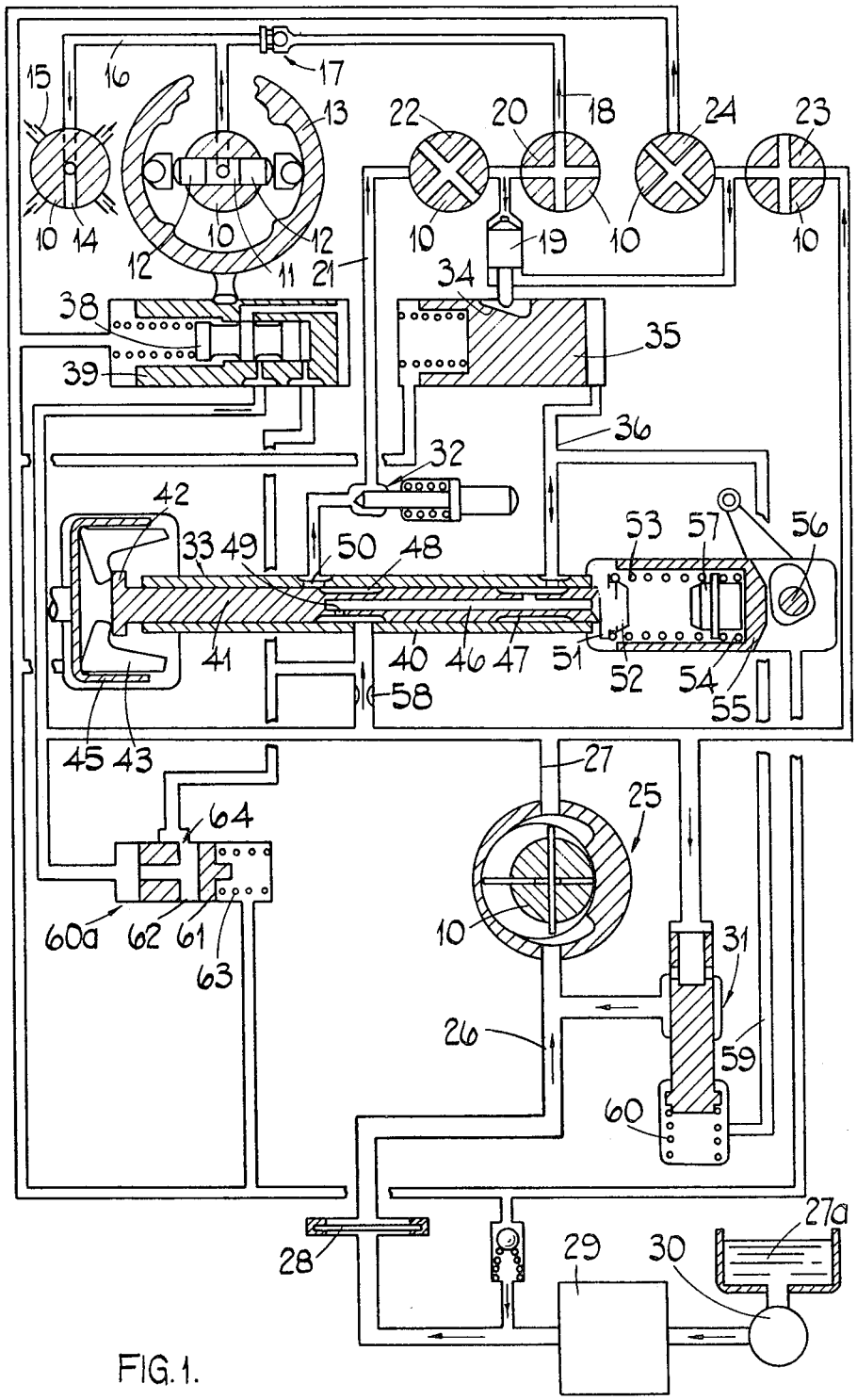
FIG. 1 is a diagrammatic representation of one example.

Referring to FIG. 1 of the drawings, the apparatus comprises a body part in which is journalled a rotary cylindrical distributor member 10 shown for convenience, divided into seven parts. The distributor member is adapted to be driven in timed relationship with an engine with which the apparatus is associated and at one point in the distributor member, there is formed a transversely extending bore 11 in which is mounted a pair of reciprocable pumping plungers 12. Surrounding the distributor member at this point is an annular cam ring 13 having on its internal periphery, a plurality of pairs of diametrically disposed cam lobes. The cam lobes through the intermediary of rollers respectively act upon rotation of the distributor member, to move the pumping plungers 12 inwardly thereby to displace fuel contained within the transverse bore 11.

The transverse bore 11 communicates with a passage 16 extending within the distributor member and at one point this passage communicates with an outwardly extending delivery passage 14 which is adapted to register in turn and as the distributor member rotates, with a plurality of outlet ports 15 formed in the body part.

The outlet ports in use, are connected to the injection nozzles respectively of the associated engine.

The passage 16 is in communication by way of a check valve 17 with a passage 18, and this passage can be brought into communication with one end of a cylinder containing a slidable shuttle 19 by means of a rotary valve 20. The aforesaid one end of the cylinder at other times, as will be explained, can be placed in communication with a feed passage 21 by a rotary valve 22.

The other end of the cylinder containing the shuttle 19 can be placed in communication with a source of fuel at a feed pressure by means of a rotary valve 23 or with a source of fuel at a low pressure by means of a rotary valve 24. The valves 20, 22, 23 and 24 are formed in or on the distributor member 10 and are driven in timed relationship with the engine. In addition, also mounted on the distributor member is a feed pump 25 of the vane type and having an inlet 26 and an outlet 27. The inlet 26 is in communication with a supply of fuel 27*a* by way of a pair of filter units 28, 29 and a lift pump 30 is provided to ensure the supply of fuel to the feed pump. The output pressure of the feed pump 25 is controlled by a relief valve 31 which spills fuel between the inlet and the outlet of the pump.

The outlet 27 of the feed pump 25 is in communication with the feed passage 21 by way of a normally open valve 32, a metering valve 33 which will be described in greater detail later in the specification and a restricted orifice 58. In addition, the outlet pressure of the feed pump is utilized to provide the aforesaid high pressure which can be supplied to the cylinder containing the shuttle 19 by way of the rotary valve 23.

The operation of the apparatus thus far described is as follows. With the parts of the apparatus in the position shown in FIG. 1, fuel is flowing from the outlet of the feed pump by way of a valve 23 to said other end of the cylinder, and the shuttle 19 is being moved towards said one end of the cylinder. Fuel is therefore displaced from this end of the cylinder and flows by way of the rotary valve 20 and the check valve 17 to the passage 16 and particularly to the bore 11. The plungers 12 are therefore moved outwardly an amount dependent upon the quantity of fuel displaced by the shuttle 19.

During continued rotation of the distributor member, the passage 14 is brought into register with an outlet port 15 and during this time the plungers 12 are moved inwardly and fuel is displaced from the bore 11 to appropriate engine cylinders. Also during this time the rotary valves 20 and 23 are closed and the valves 22 and 24 are opened so that fuel now flows to said one end of the cylinder containing the shuttle 19 and the shuttle is moved towards the other end of the cylinder. The quantity of fuel which is supplied to the cylinder is controlled by the metering valve 33 which thus determines the quantity of fuel which is supplied to the engine at each injection stroke. During continued rotation of the distributor member, the process described above is repeated and fuel is supplied to the engine cylinders in turn. It will be appreciated that the shuttle 19 determines the maximum quantity of fuel which can be supplied by the apparatus at each injection stroke. The maximum quantity of fuel which can be supplied to an engine without the emission of smoke from the exhaust of the engine varies with speed so that the maximum excursion of the shuttle must be made to vary in accordance with the speed of the engine. For this purpose the shuttle 19 is provided with an extended end portion which can co-operate with a cam surface 34 formed on a spring loaded piston 35. The piston is movable against the action of its spring by means of fuel supplied under pressure to one end of the cylinder by way of a passage 36. The pressure of the fuel is dependent upon the speed at which the apparatus is driven and the way in which it is derived will be explained. The result is that the axial setting of the piston will be dependent upon the speed and consequently the allowed excursion of the shuttle will also be dependent upon the speed.

Also provided is a servo-piston 39 which is connected to the cam ring 13 by means of a peg. The servo-piston is provided with a bore in which is mounted a spring loaded servo-valve element 38 and which controls the admission or escape of fuel under pressure from the end of the cylinder containing the piston 39. The fuel under pressure is obtained from the outlet 27 of the feed pump 25 and the servo-valve 38 is subjected to a control pressure the derivation of which will be described. As this pressure increases the servo-valve element 38 will be moved against the action of its spring towards the left as seen in FIG. 1 and the servo-piston 39 will follow this movement thereby moving the cam ring 13 angularly and altering the timing of injection of fuel to the engine.

Considering now the metering valve 33. This comprises a sleeve 40 which is fixed within the body of the apparatus. Within the sleeve there is mounted an axially slidable rod member 41 which at one end is provided with a head 42 against which bear the toe portions of a pair of governor weights 43. The weights are mounted within a cage 45 which is driven by gearing not shown, from the distributor member 10 so that the speed of rotation of the weights is directly proportional to the speed at which the apparatus is driven.

Extending axially within the rod member is a blind bore 46 and which is open to the end of the rod member remote from the weights. The bore 46 is in constant and full communication with a circumferential groove 47 formed on the periphery of the rod member, and this groove is in open communication with the passage 36. The bore 46 is in restricted communication with a further circumferential groove 48 by way of an orifice 49. The groove 48 is in communication with the outlet of the feed pump by way of the orifice 58 and is in variable communication with a port 50 formed in the sleeve 40. The port 50 communicates with the feed passage 21.

The bore 46 at its open end constitutes a spill port 51 which can be closed by a valve element 52 urged to close the port by a pair of governor springs 53, 54. These springs are partly housed within a hollow and slidable abutment 55, the position of which is controlled by an operator adjustable cam 56. Intermediate the two springs is a stop member 57 and which acts to limit the deflection of the relatively light spring 54.

In use, the axial position of the rod member 41 and therefore the degree of registration of the groove 48 and the port 50 is determined by the force acting on the one end of the rod due to the weights and the opposing force exerted by the spring or springs. For a steady speed, these forces are balanced, but should the speed vary then the rod will move axially to increase or decrease the registration of the groove and port so as to increase or decrease the quantity of fuel supplied to the engine. In this manner the weights and springs together with the rod member, the groove 48 and the port 50 act as a mechanical governor. By altering the force exerted by the spring or springs the operator can control the speed at which the engine operates.

The fuel under pressure within the bore 46 acts intermediate the rod member 41 and valve element 52 to effect separation thereof. The force developed is opposed by the force transmitted through the rod member, i.e. the force exerted by the weights or the governor springs. As the valve element is moved away from the rod member, fuel is spilled from the bore 46 and due to the orifice 49 the pressure therein falls until an equilibrium position is reached. With variation in speed, the pressure rises or falls depending on the change of speed and due to the fact that the force developed by the weights depends upon the square of the speed so the fuel pressure within the bore depends upon the square of the speed.

The light spring 54 during normal operation is fully compressed and operates as the governor spring when the engine is idling. In addition, it will be noted that in the event that the abutment 55 is moved to compress the springs 53 and 54 fully, the valve element 52 will move into contact with the end of the sleeve thereby to limit the movement of the rod member 41. This movement whilst sufficient to ensure that maximum fuel is supplied to the engine, is not sufficient to cause any significant movement of the weights 43 so that the fuel pressure within the bore 46 will be substantially unaltered.

The output pressure of the feed pump is arranged to vary in accordance with the law $(n^2 + K)$ and for this purpose there is applied to the valve element of the relief valve 31, a pressure which varies in accordance with the square of the speed at which the apparatus is driven. For this purpose a branch passage 59 is provided from the passage 36 and the branch passage 59 communicates with a chamber containing a spring 60 which loads the valve element of the relief valve towards the closed position. The fluid pressure therefore assists the force exerted by the spring 60 in moving the valve element to prevent communication between the outlet of the feed pump and its inlet. The effect of this is that the outlet pressure of the feed pump varies in accordance with the law $(n^2 + K)$.

There is also provided valve means **60*a* which is effectively connected in parallel with the orifice 58. The valve means 60*a* includes a spring loaded valve element 61 slidable within a cylinder. The valve element 61 is provided with a transversely extending bore 62 which is in constant communication with the outlet of the feed pump. Moreover, the valve element 61 is subjected to the outlet pressure of the feed pump and this moves the valve element against the action of a spring 63. Formed in the wall of the cylinder accommodating the valve element is a groove 64 which is in constant communication with the passage 27 downstream of the orifice 58. The port 62 and the orifice 64 constitute a variable orifice which is effectively connected in parallel with the orifice 58, but the size of this orifice is dependent upon the speed at which the engine is driven. At low engine speeds the registration of the port 62 and the groove 64 is such that the orifice 58 is effectively by-passed so that it has little effect. As the engine speed increases, however, the valve element 61 will be moved against the action of its spring to reduce the effective size of the orifice constituted by the port 62 and the groove 64. As a result the effective size of the orifice 58 decreases, and an increasing pressure drop will occur across the orifice. This is reflected in the pressure which is applied to the servo-valve element 38. Moreover, the pressure drop across the orifice 58 is influenced by the setting of the metering valve 33 and it will be appreciated that as the metering valve is set to provide an increased quantity of fuel to the engine, so the pressure drop across the orifice 58** will increase.

The effect of this is that at low loads the degree of advance obtained remains substantially constant up to a given engine speed and thereafter increases as the engine speed increases, whereas when an appreciable quantity of fuel is being fed to the engine as occurs under high load conditions, the degree of advance at low engine speeds is high, and thereafter decreases until substantially the aforesaid engine speed is reached, whereafter it increases.

Figure 2:
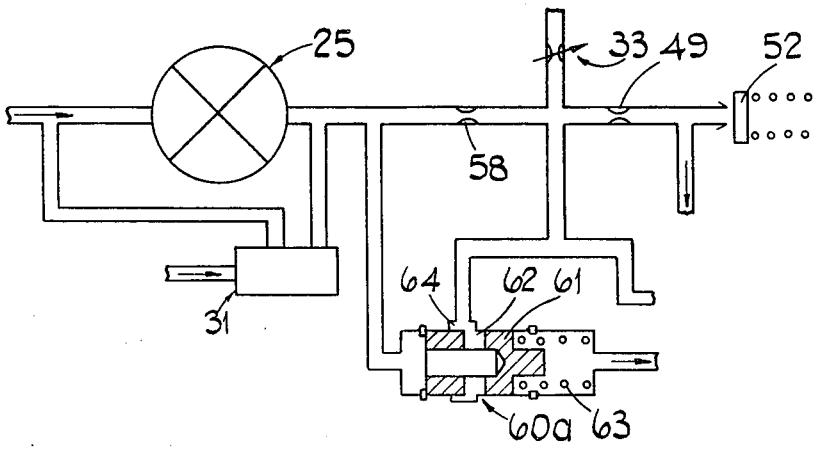
FIG. 2 shows the essential fuel circuit diagram of the apparatus shown in FIG. 1.
Figure 3:
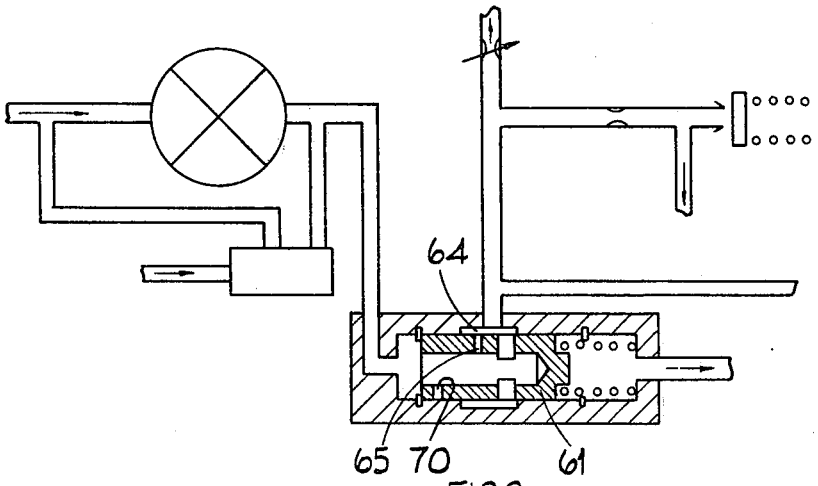
FIG. 3 shows an alternative embodiment of the examples shown in FIGS. 1 and 2.

The arrangement shown in FIG. 3 is in essence identical with the arrangement shown in FIGS. 2 and 1. In this case, however, the orifice 58 is replaced by an orifice 65 formed in the valve element 61. The orifice 65 is in constant communication with the groove 64 irrespective of the setting of the valve element 61.

Figure 4:
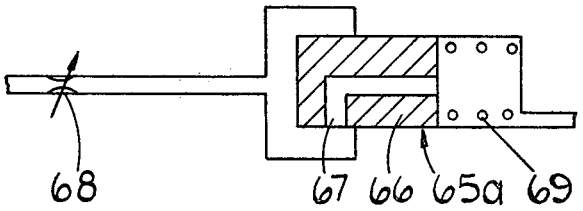
FIG. 4 shows a modification of FIG. 1.

If required the pressure which is applied to the servo-valve element 38 may be additionally modified by using a valve 65*a* shown in FIG. 4. This valve comprises a piston 66 loaded by a spring 69 and having a spill port 67 connected to a drain. The pressure side of the piston is in variable communication with a point intermediate the orifices 58 and 49 seen in FIG. 1 by way of an adjustable orifice 68. The orifice 68 is variable and its size depends upon the setting of the throttle. In other words it varies in the same way as the orifice 33. The effect of valve 65*a* is to reduce gradually the pressure applied to the servo-valve 38 and therefore to reduce the degree of advance at high fuel delivery and low engine speed.

Also shown in FIG. 3 is an additional port 70 in the valve element 61 and which is opened as the valve element is moved towards its maximum extent against the action of the spring 69. The port 70 serves to modify the load/speed signal characteristic at high speeds.

We claim:

1. A liquid fuel injection pumping apparatus for supplying fuel to an internal combustion engine and comprising an injection pump for supplying fuel in timed relationship to an associated engine, a fluid pressure operable element for controlling the timing of delivery of fuel to the engine, a feed pump, a conduit connecting the feed pump and the injection pump, the feed pump supplying fuel to the injection pump during the filling strokes of the injection pump, throttle means in said conduit for controlling the amount of fuel supplied by the feed pump to the injection pump, a first orifice disposed in said conduit upstream of said throttle means, a passage branching off said conduit from intermediate said first orifice and said throttle means, a second orifice disposed in said passage, valve means disposed in said passage downstream of said second orifice for controlling the pressure of fuel downstream of the second orifice so that it varies in accordance with the square of the speed at which the injection pump is driven, passage means through which the pressure intermediate said first and second orifices is applied to said element, a relief valve means for controlling the output pressure of the feed pump so that it varies substantially in accordance with the law $(N^2 + K)$ where N represents the speed at which the injection pump is driven and K is a constant, and further valve means including a variable orifice connected in parallel with said first orifice, said further valve means including a member responsive to the output pressure of the feed pump and arranged so that as the output pressure of the feed pump increases the effective size of the variable orifice is decreased.

2. An apparatus according to claim 1 in which said member of the valve means comprises a cylinder, a valve element movable within said cylinder, said valve element at one end being subjected to the outlet pressure of the feed pump, resilient means opposing movement of said valve element by said pressure, and port means defined by the valve element and the wall of the cylinder, said port means constituting said variable orifice.

3. An apparatus according to claim 2 in which said port means comprises a groove formed in the wall of the cylinder, said groove being in constant communication with the downstream side of said first orifice, and a port formed in the side surface of the valve element for variable communication with said groove depending on the position of the valve element, said port opening out onto the end of the valve element exposed to the outlet pressure of the feed pump.

4. An apparatus according to claim 3 in which said first orifice is constituted by a further port in the valve element, said further port being positioned on the valve element so that its communication with said groove is unaffected by the position of the valve element.

5. An apparatus according to claim 1 including a further valve operable to adjust the pressure in said conduit intermediate said first orifice and said throttle means, said further valve adjusting said pressure in accordance with the setting of the throttle means and the engine speed.

6. An apparatus according to claim 1 in which said relief valve means comprises a valve element, a spring loading the valve element, said valve element being subjected at one end to the outlet pressure of the feed pump and being movable by said pressure against the action of said spring to increase the size of a spill port, and conduit means through which a pressure proportional to the square of the speed of the injection pump is applied to the other end of said valve element whereby the outlet pressure of the feed pump varies substantially in accordance with the law $(N^2 + K)$.

7. An apparatus according to claim 6 including a further conduit connected to a point intermediate said first orifice and said throttle means, a further orifice in said further conduit and centrifugally operable valve means disposed downstream of said further orifice said centrifugally operable valve means acting to control the flow of fuel through said further orifice so that the pressure downstream of said further orifice varies in accordance with the square of the speed at which the injection pump is driven.

8. An apparatus according to claim 7 in which said conduit means communicates with said further conduit downstream of said further orifice.

* * * * *